US008556538B2

(12) United States Patent
Hawkes et al.

(10) Patent No.: US 8,556,538 B2
(45) Date of Patent: Oct. 15, 2013

(54) DEPLOYABLE OPTICAL FIBER CARTRIDGE

(75) Inventors: Graham Hawkes, San Anselmo, CA (US); Jonathan Epstein, Pt. Richmond, CA (US)

(73) Assignee: Bluefin Robotics Corporation, Quincy, MA (US)

( * ) Notice: Subject to any disclaimer, the term of this patent is extended or adjusted under 35 U.S.C. 154(b) by 319 days.

(21) Appl. No.: 12/793,589

(22) Filed: Jun. 3, 2010

(65) Prior Publication Data

US 2011/0299932 A1 Dec. 8, 2011

(51) Int. Cl.
*F16L 1/12* (2006.01)

(52) U.S. Cl.
USPC ..... 405/158; 405/154.1; 405/168.3; 405/190; 405/191

(58) Field of Classification Search
USPC ..... 405/154.1, 158, 165, 166, 168.1, 168.3, 405/190, 191
See application file for complete search history.

(56) References Cited

U.S. PATENT DOCUMENTS

| | | | | |
|---|---|---|---|---|
| 2,004,229 | A * | 6/1935 | Traver | 68/206 |
| 4,589,174 | A * | 5/1986 | Allen | 29/33 R |
| 4,696,438 | A * | 9/1987 | Myers | 242/118.41 |
| 5,370,074 | A * | 12/1994 | Knudsen et al. | 114/312 |
| 6,588,980 | B2 * | 7/2003 | Worman et al. | 405/158 |
| 2003/0113092 | A1 * | 6/2003 | Porter | 385/147 |
| 2008/0284441 | A1 * | 11/2008 | Kowalczyk et al. | 324/334 |

FOREIGN PATENT DOCUMENTS

WO WO 02/052304 * 7/2002

* cited by examiner

*Primary Examiner* — Sean Andrish
(74) *Attorney, Agent, or Firm* — Paul K. Tomita

(57) ABSTRACT

A spool has a cylinder, a first flange coupled to a first end of the cylinder and a second flange coupled to a second end of the cylinder. A compressible material surrounds the cylinder and an optical fiber is wrapped around the compressible material. When tension is applied to the optical fiber the compressible material can be deformed to reduce the tension on the optical fiber. When submerged underwater the water pressure will not compress the compressible material.

11 Claims, 7 Drawing Sheets

DEPLOYABLE OPTICAL FIBER CARTRIDGE

FIELD OF INVENTION

The application is directed towards a spool that can be used for storing a fiber in underwater applications.

BACKGROUND

Fibers such as optical fibers have been used in underwater applications to transmit and receive information. For example, an underwater device can have a propulsion system and a direction control mechanism. The underwater device can be deployed by a support ship and an optical fiber can be coupled between the underwater device and the support ship. The support ship can transmit control information to the underwater device that is used to operate the direction control mechanism.

SUMMARY OF THE INVENTION

An optical fiber is stored on a spool having a cylindrical portion and a compressible member over the cylindrical portion. The compressible member is not affected by ambient water pressure. Thus, when the spool is submerged, the water will saturate the compressible member and the water pressure will not cause the compressible member to collapse. When the optical fiber is wound on the spool, the tension will cause the compressible member to be slightly compressed. This cushioning prevents excess tension from being applied to the optical fiber. In an embodiment, the compressible member is an open cell foam. When the spool is submerged the water fills the cells and the open cell foam will not collapse under pressure. In other embodiments, the compressible member can include a mechanical spring. When submerged, the water will fill the spaces between the spring and the spool. The springs will not be compressed by the water pressure. In order to improve the movement of water into the compressible member, the spool may have holes or openings.

If the compressible member of the spool was made of a closed cell foam, the pressure would eventually cause the compressible member to collapse. This would cause the optical fiber to become loose on the spool and potentially tangled. In order to properly utilize the optical fiber, it must not be tangled as it is removed from the spool.

The spool of optical fiber may be placed on a remotely operated vehicle (ROV). As the ROV moves through the water, a feed system will pull the optical fiber from the spool at a rate that is approximately equal to or faster than the movement of the ROV. By emitting the optical fiber from the ROV, the optical fiber is essentially stationary in the water and there is no tension applied to the fiber. If the optical fiber becomes tangled, it will not go through the feed system and the movement of the ROV can create tension and possibly breakage of the optical fiber. In another embodiment, a second spool of optical fiber can be mounted in a surface structure on or adjacent to a surface support ship. A second feed system can be coupled to the second optical fiber spool. If the ship moves, the optical fiber can be released from the second spool to prevent tension in the fiber.

DETAILED DESCRIPTION

Figure 1:
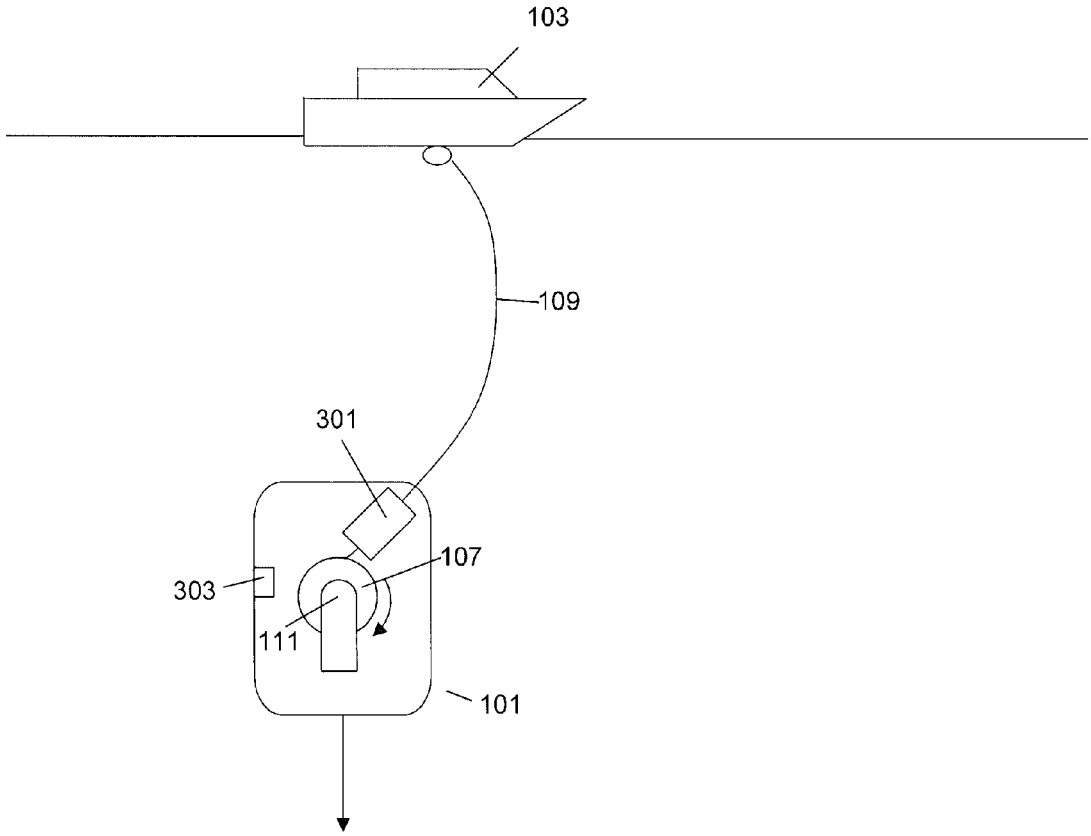
FIG. 1 illustrates an ROV having a spool storing an optical fiber.

The present invention is directed towards a spool for storing a fiber for underwater applications. With reference to FIG. 1, in an embodiment, the fiber can be an optical fiber 109 that is stored on a spool 107 that is used for communications between a support ship 103 and a Remotely Operated Vehicle (ROV) 101. An end of the optical fiber 109 can be coupled to communications equipment on the support ship 103 and the other end of the optical fiber 109 can be coupled to communications and control equipment on the ROV 101.

The spool 107 of the optical fiber 109 is stored on the ROV 101. As the ROV 101 travels, the spool 107 can rotate which causes the optical fiber 109 to stream out of the ROV 101. The end of the optical fiber 109 can be coupled to a rotating coupling 111 so the spool 107 can rotate freely. In an embodiment, a sensor can detect the relative velocity of the ROV 101 through the water and then control the rotational rate of the spool 107 to emit the optical fiber 109 at a rate that is substantially equal to or greater than the relative velocity of the ROV 101 through the water.

In an embodiment, a feeder mechanism 301 is used to remove the optical fiber 109 from the spool 107. The spool 107 can be mounted on an axle which allows the spool 107 to rotate. The feed mechanism 301 can be coupled to a velocity sensor 303 that detects the speed of the ROV 101 through the water. The feed mechanism 301 can remove the optical fiber 109 from the spool 107 at a rate that is equal to or greater than the velocity of the ROV 101. In order for the optical fiber 109 to be removed smoothly, the compressible cylindrical structure must maintain a constant tension on the optical fiber 109 regardless of the ambient pressure.

In order for the optical fiber 109 to be properly drawn from the spool 107, the optical fiber 109 must be wrapped around the spool 107 with a small amount of tension, for example, less than 1 pound of tension. If the optical fiber 109 is loose on the spool 107, it may become tangled as it is removed from the spool 107. This can result in damage or breakage of the optical fiber 109. The optical fiber 109 can have a tensile strength of about 10 pounds, however, it is very brittle and can be easily broken if bent. Thus, if the tangles to the optical fiber results in excessive tension or bending, the optical fiber 109 can very easily break resulting in a complete loss of control and communication between the ROV 101 and the support ship 103.

Figure 2:
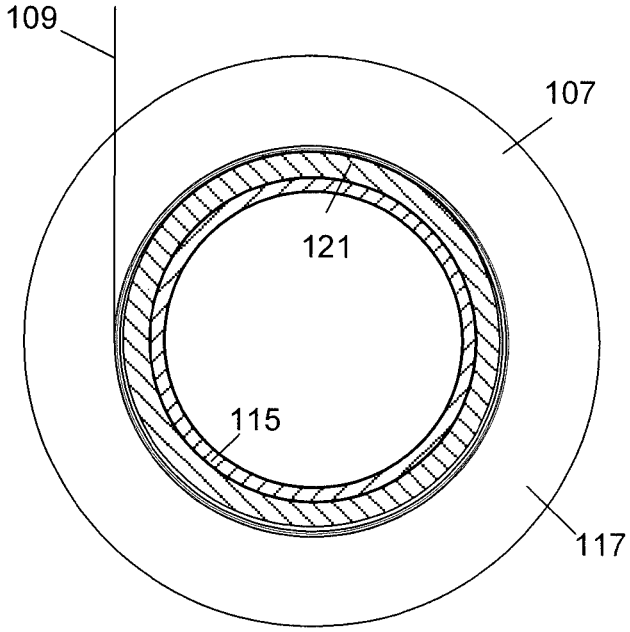
FIG. 2 illustrates a cross section side view of a spool storing an optical fiber.
Figure 3:
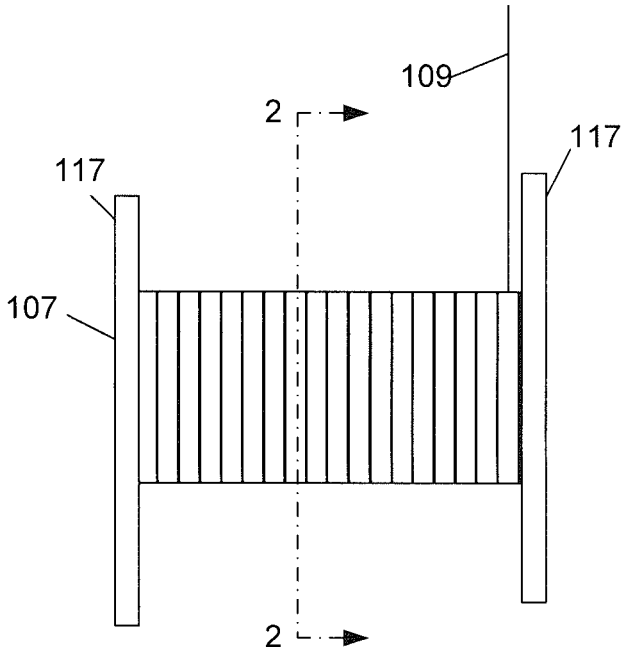
FIG. 3 illustrates a front view of a spool storing an optical fiber.

In order to maintain a proper tension of the optical fiber 109 on the spool 107, the optical fiber 109 can be wrapped around a compressible cylindrical structure 121. In an embodiment, FIG. 2 is a cross sectional view of the spool 107 at the plane A-A shown in FIG. 3 which is a front view of the spool 107. The spool 107 can include a rigid center cylindrical portion 115, flanges 117 and an elastic compressible cylindrical structure 121 that surrounds the rigid center cylindrical portion 115. In an embodiment, the outer diameter of the compressible cylindrical structure 121 may be about 5-9 inches in diameter. However, in other embodiments, the diameter can be larger or smaller. The optical fiber 109 is wrapped around the outer diameter of the compressible cylindrical structure 121. The optical fiber 109 is wrapped at a predetermined tension around the compressible cylindrical structure 121. In an embodiment, the tension can be between about 0.001 to 1 pounds of force.

Figure 4:
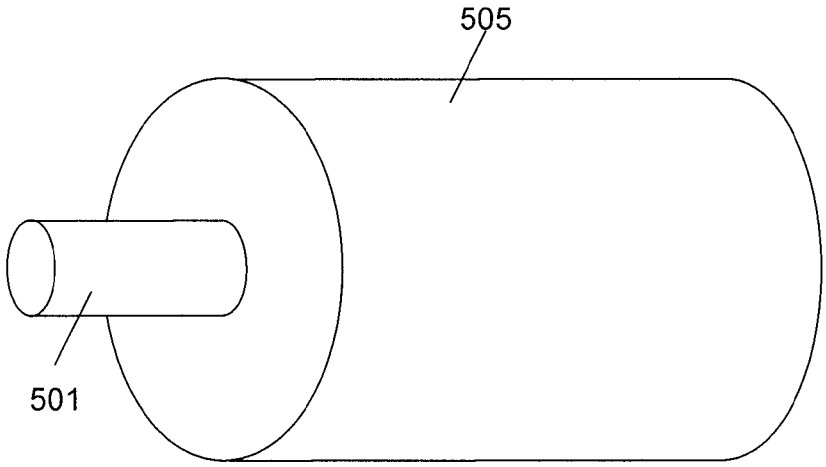
FIG. 4 illustrates a view of an end of an optical fiber.

With reference to FIG. 4, in an embodiment the optical fiber can include a core 501 that is an optical transmitter and a plastic coating 505. In an embodiment, the core 501 may be about 10 μm in diameter and can be surrounded by a coating 505 that has an outer diameter of about 125 μm. In other embodiments, the core can be about 5-400 μm in diameter and the coating can have a diameter of about 50-500 μm. The core can be made of glass. However, in other embodiments, the core can be made of other materials, such as fluorozirconate, fluoroaluminate, and chalcogenide glasses as well as crystalline materials like sapphire. Silica and fluoride glasses usually have refractive indices of about 1.5, but some materials such as the chalcogenides can have indices as high as 3. Typically the index difference between core 501 and coating 505 is less than one percent. In other embodiments, the core 501 can be made of plastic optical fibers (POF) that may have a core diameter of 0.5 millimeters or larger.

The optical fiber 501 can have one or more coatings. An inner primary coating 505 can act as a shock absorber to minimize attenuation caused by microbending. Fiber optic coatings can be applied in various different methods. In a "wet-on-dry" process, the optical fiber passes through a primary coating application, which is then UV cured. The fiber optic coating is applied in a concentric manner to prevent damage to the fiber during the drawing application and to maximize fiber strength and microbend resistance.

Figure 5A:
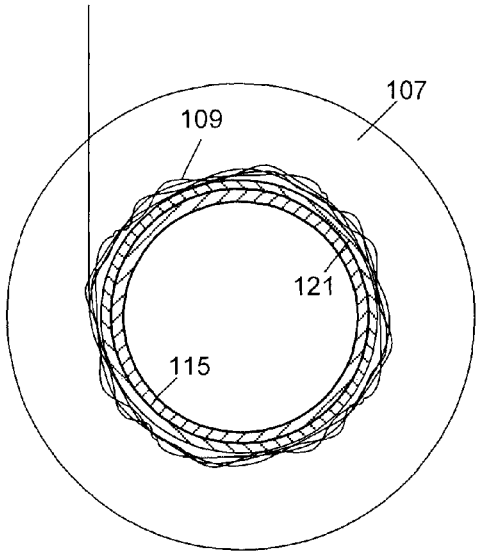
FIG. 5A illustrates a cross section side view of a spool with a tangled optical fiber.
Figure 5B:
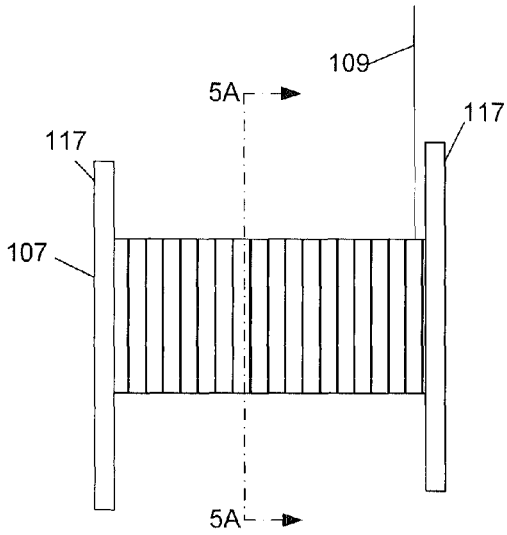
FIG. 5B illustrates a front view of a spool storing an optical fiber.

Because the spool is being used in a pressurized underwater environment, the compressible cylindrical structure cannot be deformed by increased water pressure. The ambient pressure is directly proportional to the depth of the ROV in the water. For example, in fresh water the pressure increase is about 0.43 pounds per square inch gage (PSIG) per foot of depth and in salt water, the pressure increase is about 0.44 PSI per foot of depth. Thus, a 100 foot dive will result in an ambient pressure of 43-44 PSIG and a 5,000 foot dive will result in an ambient pressure of 2,150 -2,200 PSIG. The compressible cylindrical structure 121 must be able to retain its shape and remain compressible in very high ambient pressures. With reference to FIG. 5A, if the compressible cylindrical structure 121 is made of a material that deforms under pressure and the spool is submerged, the optical fiber 109 will become loose at a fairly shallow depth. This will cause the optical fibers 109 to be disorganized on the spool 107 and possibly tangled. As the optical fiber 109 is drawn from the spool 107, the tension will not be uniform and the optical fiber 109 will become tangled. FIG. 5B is a front view of the spool 107 with flanges 117 for storing the optical fiber 109.

Figure 6A:
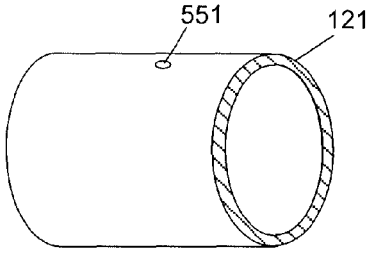
FIG. 6A illustrates a compressible cylindrical member made of closed cell foam.
Figure 6B:
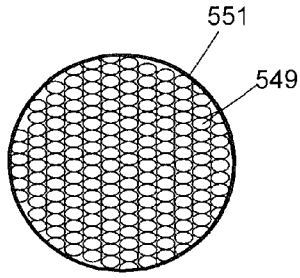
FIG. 6B illustrates an enlarged view of the closed cell foam.

With reference to FIG. 6A and 6B, FIG. 6A illustrates a foam cylinder 121 and FIG. 6B illustrates a detailed view of the closed cell foam 549 in a small portion 551 of the cylinder 121. Closed cell foams 551 are an example of a material that will deform under pressure. Solid foams 551 have individual pore structures or cells 549 that are not interconnected. Because the cells 549 are filled with a compressible gas, when the closed cell foam 551 is exposed to high pressure, the cells 549 collapse. As the ROV travels deeper into the water, the ambient pressure can cause the cylindrical structure 121 to be compressed. When the compressible cylindrical structure 121 compressed, the outer diameter is compressed and the optical fiber 109 will become loose on the spool 107. Thus, a closed cell foam 551 or any other pressure compressible material should not be used as the compressible cylindrical structure 121 material.

Figure 7A:
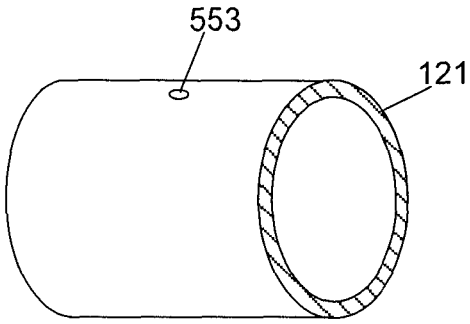
FIG. 7A illustrates a compressible cylindrical member made of open cell foam.
Figure 7B:
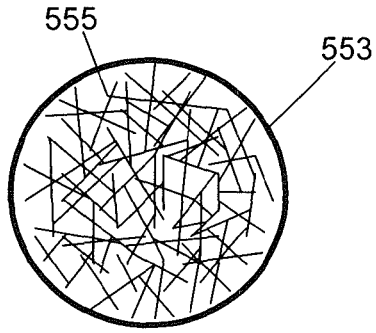
FIG. 7B illustrates an enlarged view of the open cell foam.

With reference to FIG. 7A and 7B, FIG. 7A illustrates another foam cylinder 121 and FIG. 7B illustrates a detailed view of the open cell foam structure 555 In a small portion 553 of the cylinder 121. In contrast to closed cell foam, in an embodiment the compressible cylindrical structure 121 can be made of an open cell foam material 555. As the ROV is submerged into a body of water, the water can fill the open cells of the compressible cylindrical structure 121. Thus, the increased ambient pressure will not cause the cylindrical structure 121 to compress. The cylindrical structure 121 maintains the tension on the optical fiber and allows the optical fiber to be removed from the spool without becoming tangled.

Figure 8:
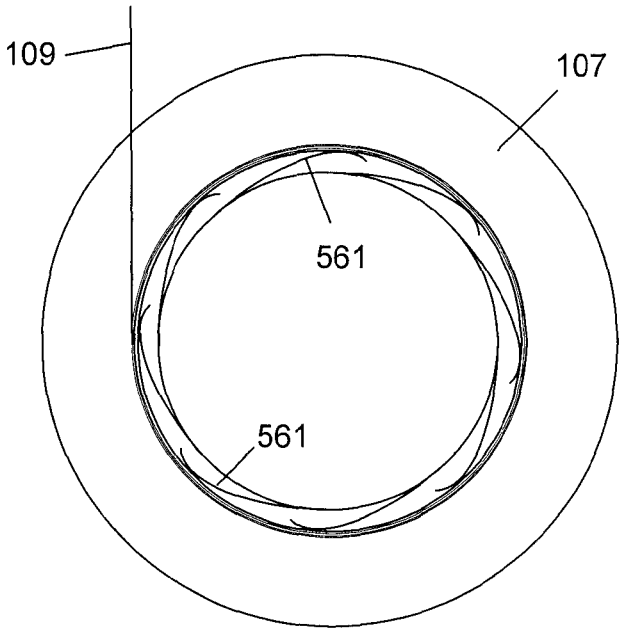
FIG. 8 illustrates a compressible cylindrical member made of mechanical springs.

In other embodiments, other materials or structures can be used that do not compress with ambient pressure. With reference to FIG. 8, in another embodiment, the spool 107 may include a plurality of springs 561 that make the cylindrical structure compressible. The springs 561 may be elongated sheets of a flexible material. When tension is applied to the optical fiber 109, the tension will compress the springs 561 towards the center of the spool 107. Because the springs 561 have an open design, water can freely flow around the springs 561 so that the ambient pressure does not cause the springs 561 to compress.

Because the optical fiber can be very closely spaced when wound on the spool, water may not flow through the optical fiber to compressible cylindrical structure of the spool easily. Similarly, if the spool is not made of a water permeable material, the water may not be able to easily reach the cylindrical structure when the spool is submerged. The water can be blocked from the inner diameter by the inner surface of the spool and the flanges can block water from the sides.

Figure 9:
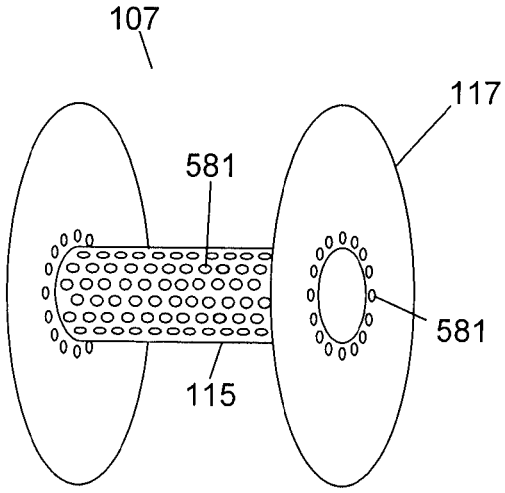
FIG. 9 illustrates a spool having water flow holes.

With reference to FIG. 9, in order to ease the ability of the water to reach the compressible cylindrical structure, holes 581 may be placed in the flanges 117 and/or in the cylindrical portions 115 of the spool 107. Thus, water can flow through the holes 581 and fill the compressible cylindrical structure. If the compressible cylindrical structure is made of an open cell foam or other open construction, the water can flow through the holes 581 of the spool 107 and into the open cells or other open features of the compressible cylindrical structure.

Figure 10:
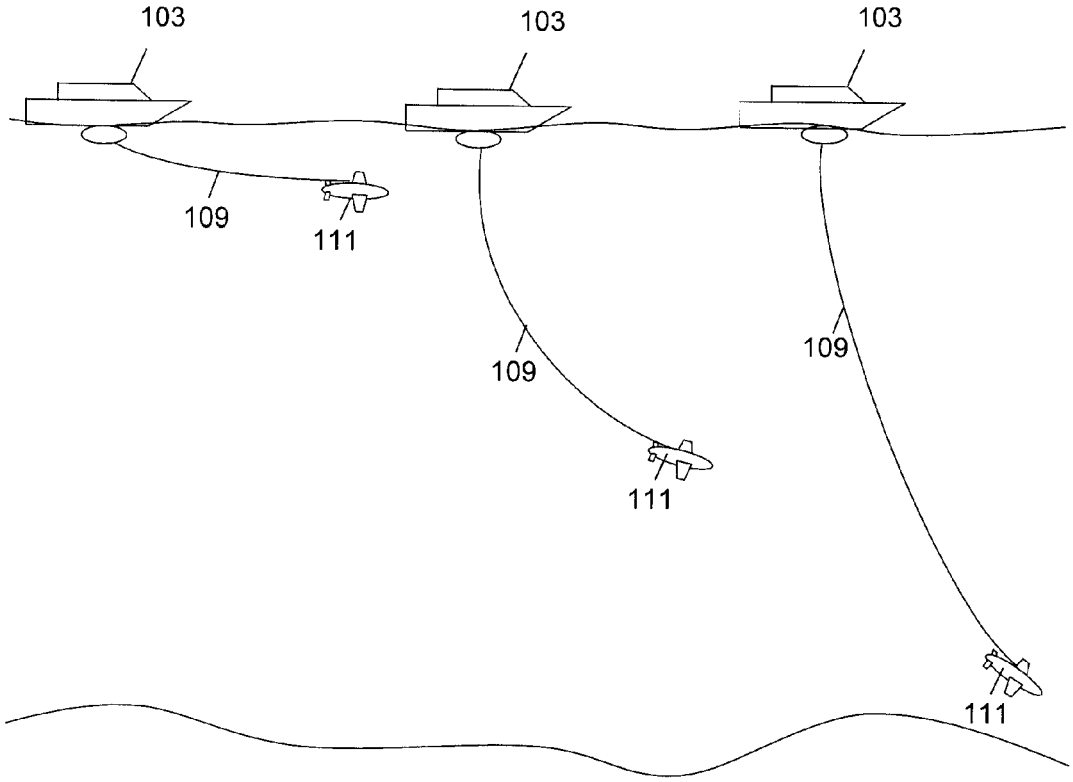
FIG. 10 illustrates an ROV and a support boat.

With reference to FIG. 10, in an embodiment, the opposite ends of the optical fiber 109 can be wrapped around two separate spools or the system can use two optical fibers wound on two different spools that are connected. Each of the spools can be similar to the spool shown in FIG. 1. One spool can be mounted in an ROV 111 that travels away from a support ship and a second spool can be mounted close to the surface and may be connected to a support ship 103. The ROV 111 can be a "winged submersible" that is described in U.S. Pat. No. 7,131,389 which is hereby incorporated by reference. As the ROV 111 travels away from the support ship 103, the optical fiber 109 is removed from the spool in the ROV 111. Similarly, as the support ship 103 moves through the water due to propulsion or current, the optical fiber 109 is removed from the second spool. Thus, the optical fiber 109 is not tensioned significantly even if the ROV 111 and the support ship 103 move. Because even a low amount of pressure may be sufficient to compress a closed cell foam, the spool 107 used with the support ship may also include a compressible cylindrical structure 121 that is not compressed by ambient fluid pressure.

It will be understood that the inventive system has been described with reference to particular embodiments, however additions, deletions and changes could be made to these embodiments without departing from the scope of the inventive system. Although the systems that have been described include various components, it is well understood that these components and the described configuration can be modified and rearranged in various other configurations.

What is claimed is:

1. A method of using an optical fiber in an underwater application comprising:

providing a remotely operated vehicle (ROV) having a spool of optical fiber, the spool having a cylindrical section, an open cell foam surrounding the cylindrical section and the optical fiber wrapped around the open cell foam at a first tension level, a first end of the optical fiber coupled to a controller;

connecting a second end of the optical fiber to an optical signal transmitter;

submerging the ROV into a body of water;

filling cells of the open cell foam with water;

pressurizing the spool of optical fiber and maintaining the optical fiber wrapped around the compressible material at the first tension level at a depth in the body of water of more than 100 feet; and transmitting optical signals through the optical fiber on the spool as the ROV moves through the body of water.

2. The method of claim 1 further comprising:

transmitting optical signals from the optical signal transmitter through the optical fiber to the controller.

3. The method of claim 1 further comprising:

transmitting optical signals from the controller through the optical fiber to the optical signal transmitter.

4. The method of claim 1 further comprising:

rotating the spool to remove the optical fiber from the ROV.

5. The method of claim 1 wherein the first flange and the second flange of the spool have a plurality of holes.

6. The method of claim 1 further comprising:

providing fluid velocity sensor for detecting a velocity of the ROV through the water and an optical fiber feeder mechanism coupled to a fluid velocity sensor; and removing the optical fiber from the spool by the optical fiber feed mechanism at a rate that is faster than the velocity of the ROV.

7. An apparatus for use in underwater application comprising:

a remote operated vehicle (ROV) having a spool with:

a cylindrical section having a plurality of water flow holes that extend through a cylindrical wall, a first flange coupled to one end of the cylindrical section, a second flange coupled to a second end of the cylindrical section and a compressible cylinder surrounding the cylindrical section, the compressible cylinder is made of an open cell foam material which is filled with ambient water, an optical fiber wrapped around the compressible cylinder, the ROV having a feeder mechanism for pulling the optical fiber from the spool and a receiver coupled to a first end of the optical fiber;

a transmitter coupled to a second end of the optical fiber for transmitting control signals to the ROV.

8. The apparatus of claim 7 wherein the water flow holes are formed on the first flange adjacent to the optical fiber.

9. The apparatus of claim 7 wherein the ROV is a winged submersible.

10. The apparatus of claim 7 further comprising:

a velocity sensor for detecting a velocity of the ROV;

wherein the feeder mechanism is coupled to the velocity sensor.

11. The apparatus of claim 7 wherein the compressible cylinder comprises one or more springs.

* * * * *